United States Patent [19]

Shieh

[11] Patent Number: 4,940,267

[45] Date of Patent: Jul. 10, 1990

[54] BRACING MEDIUM FOR CASE OR THE LIKE

[76] Inventor: Jin-Ren Shieh, No. 178, Shih Chia Rd., Taichung City, Taiwan

[21] Appl. No.: 407,198

[22] Filed: Sep. 14, 1989

[51] Int. Cl.[5] ..... E05C 17/34

[52] U.S. Cl. ..... 292/263; 70/94; 217/60 E

[58] Field of Search ..... 70/94; 217/60 E; 292/263

[56] References Cited

U.S. PATENT DOCUMENTS

| | | | |
|---|---|---|---|
| 1,472,920 | 11/1923 | Lane | 292/263 |
| 2,117,013 | 5/1938 | Bernhard | 292/263 |
| 2,421,889 | 6/1947 | Jakeway | 217/60 E |
| 2,895,632 | 7/1959 | Hendrickson et al. | 217/60 E |
| 3,135,376 | 1/1979 | Evans et al. | 70/94 |
| 4,491,355 | 1/1985 | Marinoni | 292/263 |
| 4,614,376 | 9/1986 | Frampton et al. | 292/263 X |

*Primary Examiner*—Richard E. Moore

*Attorney, Agent, or Firm*—Cushman, Darby & Cushman

[57] ABSTRACT

A bracing medium for a case combines together a bracing mechanism and a lock. The bracing medium includes two mutually pivotable arms, a housing mounting therein a follower, a lock having a keyhole reachable from the outside of the case, a pawling member and a clutch mechanism mounted between the tumbler of the lock and the pawling member to enable them simultaneously rotatable. The pawling member can be positioned in a first or second position in order that it can pawl the follower against rotating in a first or second opposite direction.

8 Claims, 4 Drawing Sheets

BRACING MEDIUM FOR CASE OR THE LIKE

BACKGROUND OF THE INVENTION

The present invention relates to a bracing mechanism for a case or the like, and also to a lock for a case or the like.

Conventionally, a bracing mechanism for a suitcase, trunk or the like includes an upper arm and a lower arm capable of cooperating with each other to brace and prevent the cover from falling over the body of the case only when the cover is enough pivoted to a predetermined angle with respect to the body.

If the cover is pivoted by an angle smaller than the predetermined angle, it will automatically cover against the body immediately after the foreign force holding the cover disappears. It is the nature of the human being that one will not fully open the cover in order to get the articles received in the body even if he knows that the cover may fall down and that by fully opening the cover, it is quite possible for him to get the articles in an easier, quicker and safer manner. It goes without saying that although he can hold the cover with one hand and get the articles with the other hand, it is inconvenient and inefficient. In addition, the bracing mechanism is independent from the lock used for the case in use or in assembly.

SUMMARY OF THE INVENTION

It is therefore an object of the present invention to provide a bracing medium for a case or the like, which enables the cover of the case to be positioned in any opening angle pivoted by the user.

It is further an object of the present invention to provide a bracing medium for a case or the like, which combines thereto a lock.

According to the present invention, a bracing medium for a case having a body and a cover includes an upper arm having a first end pivotally connected to the cover and a second engaging end, a lower arm having a first end pivotably connected to the second engaging end and a second free end, a housing held attached to the body, a follower secured to the second free end and rotatably mounted in the housing, a lock having a tumbler having a keyhole reachable from an outside of the case, a pawling member engageable with the follower and limitedly rotatably mounted in the housing in the manner that when positioned in a first position it can pawl the follower against rotating in a first direction and when positioned in a second position it can pawl the follower against rotating in a second opposite direction, and a clutch mechanism mounted between the tubular and the pawling member which are mutually engageable to simultaneously rotate by a key to selectively position the pawling member in one of the first and second positions.

Certainly, the present bracing medium for a case or the like can further be provided with a restoring mechanism which is generally mounted in the housing and capable of rotating the pawling member without a key in order to change therefor from one of the first and second positions which prevents the cover from being covered against the body into the other.

The present invention may best be understood through the following description with reference to the accompanying drawings, in which:

DETAILED DESCRIPTION OF THE PREFERRED EMBODIMENT

Figure 1:
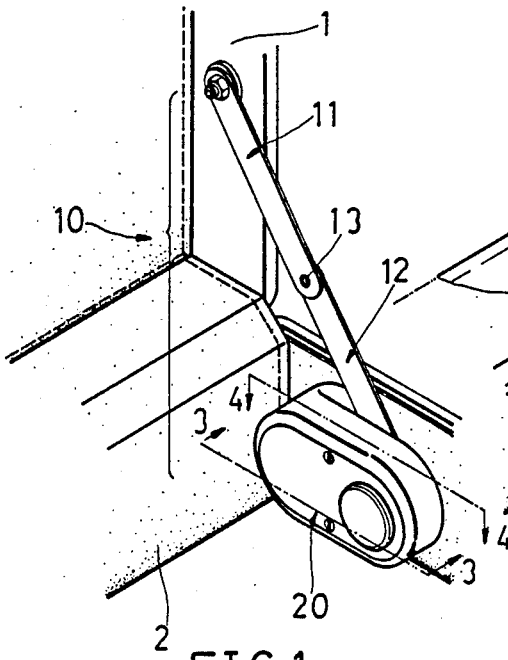
FIG. 1 is a perspective view showing a preferred embodiment of a bracing medium for a case or the like according to the present invention with the case being opened.

Referring now to FIGS. 1–5, a bracing medium 10 for a case or the like having a cover 1 and a body 2 according to the present invention includes an upper arm 11 having a first end pivotally connected to cover 1 and a second engaging end, a lower arm 12 having a first end pivotably connected to the second engaging end at a point 13 and a second free end, and a bracing mechanism 20 which includes a housing 21, a cover plate 22, a follower 23, a pawling mechanism 24, a lock 25, and a clutch mechanism 26 mounted between pawling mechanism 24 and lock 25.

Housing 21 includes an elliptical portion 27 having two side screw holes 35, 36 and an 8-shaped receiving room 29 having a side hole 291, and an extending tubular portion 28 having a hollow center 30 communicating with receiving room 29. Cover plate 22 having an end hole 39 includes two side screw holes 33, 34 through which and screw holes 36, 35 two bolts 31, 32 can respectively pass to be threaded into and held attached to body 2 thereby.

Follower 23 includes an axle 37 having two ends thereof respectively rotatably mounted in holes 291 and 39 with one end thereof being secured to the second free end of lower arm 12, and a ratchet wheel 38 mounted on axle 37.

Pawling member 24 includes a shaft 40 rotatably urged against an indentation 48 of cover plate 22, and an incomplete annulus 41 which is mounted on shaft 40 and includes two pawling ends 42, 43 and two spaced indentations 44, 45 each of which is capable of being urged against by a ball 49 partly received in a recess 51 (of elliptical portion 27) receiving therein a coil spring 50 so that pawling member 24 is limitedly rotatably mounted in housing 21.

Lock 25 includes a lock body 52 having a diametrally larger portion 521 and a smaller portion 522 defining therebetween a shoulder portion 523, and a tumbler 53 of the prior art type not to be described further. Larger portion 521 is rotatably mounted in hollow center 30 with an axial keyway 524 thereof engaging therein a key 58 provided in tubular portion 28 and smaller portion 522 is rotatably mounted in body 2 so that a key can be inserted from the outside of body 2 into a keyhole of tumbler 53 to push forward tumbler 53 a predetermined distance in order to rotate tumbler 53.

Clutch mechanism 26 includes a coil spring 65, a cap member 66 having a central rectangular hole 68, and a rectangularly crosssectional engaging piece 67 integrally formed to tumbler 53 and passing through cap member 66 which cooperates with an end annular groove 47 of shaft 40 to mount therebetween coil spring 65 so that when the key is inserted into tumbler 53 to push tumbler 53 forward, engaging piece 67 will be inserted into a corresponding end rectangularly crossectional hole 46 of shaft 40 so that the key can simultaneously rotate tumbler 53 and pawling member 24 and when the key disengages from end hole 46, spring 65 will disengage pawling member 24 (or shaft 40) from lock 25 (or tumbler 53 or piece 67).

Figure 5:
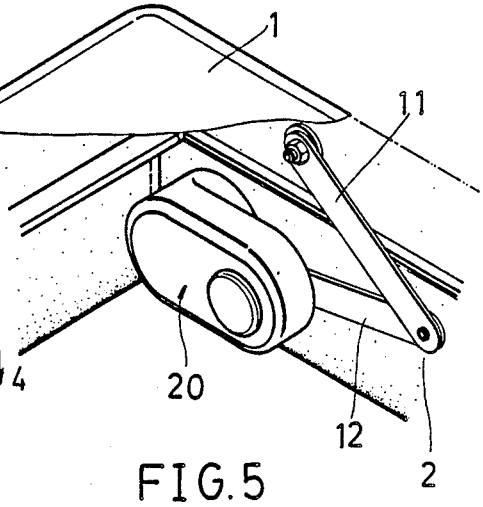
FIG. 5 is a perspective view showing a bracing medium in FIG. 1 with the case being closed.
Figure 4:
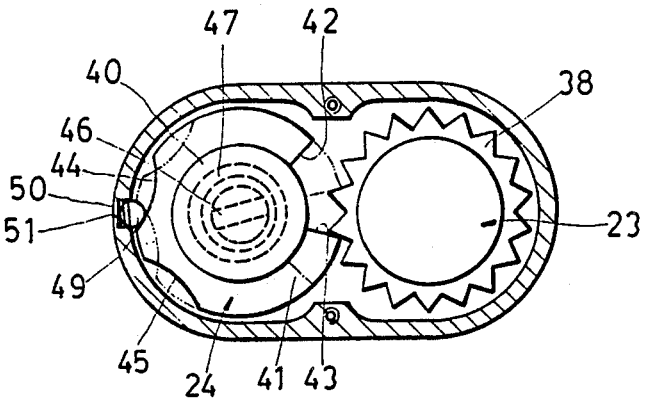
FIG. 4 is a sectional view taken along line 4—4 in FIG. 1.
Figure 3:
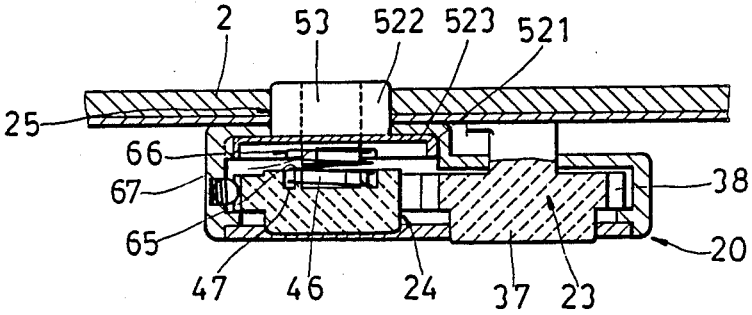
FIG. 3 is a sectional view taken along line 3—3 in FIG. 1.
Figure 2:
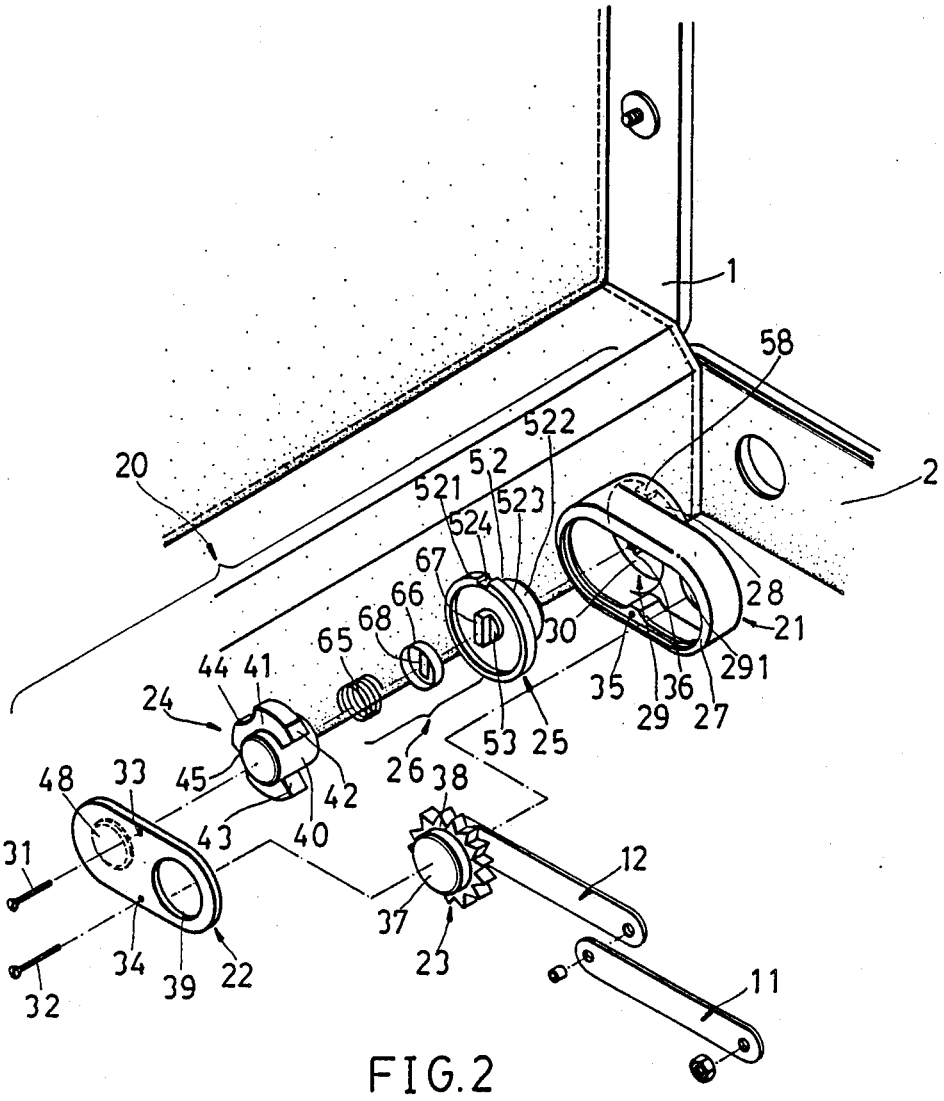
FIG. 2 is an exploded view showing a bracing medium in FIG. 1.

The operation of the present bracing medium 10 is as follows:

At the closed state of the case (1, 2), as shown in FIGS. 4 & 5, pawling end 43 engages with ratchet wheel 38 and ball 49 urges against indentation 44 to pawl wheel 38 against rotating counterclockwise or to prevent cover 1 from being pivoted away from body 2. When the key is inserted into tumbler 53 to bring pawling end 42 into contact with ratchet wheel 38 as shown by the dotted line in FIG. 4, wheel 38 or follower 23 is then blocked from rotating clockwise which means that cover 1 can only be pivoted away from body 2 and will not automatically fall over body 2 if the foreign force holding cover 1 disappears.

If the case is then desired to be closed, the key is inserted into the tumbler 53 to engage engaging piece 67 in end hole 46 in order to bring pawling end 43 into contact with ratchet wheel 38 to enable cover 1 to be covered on and locked against body 2.

Figure 7:
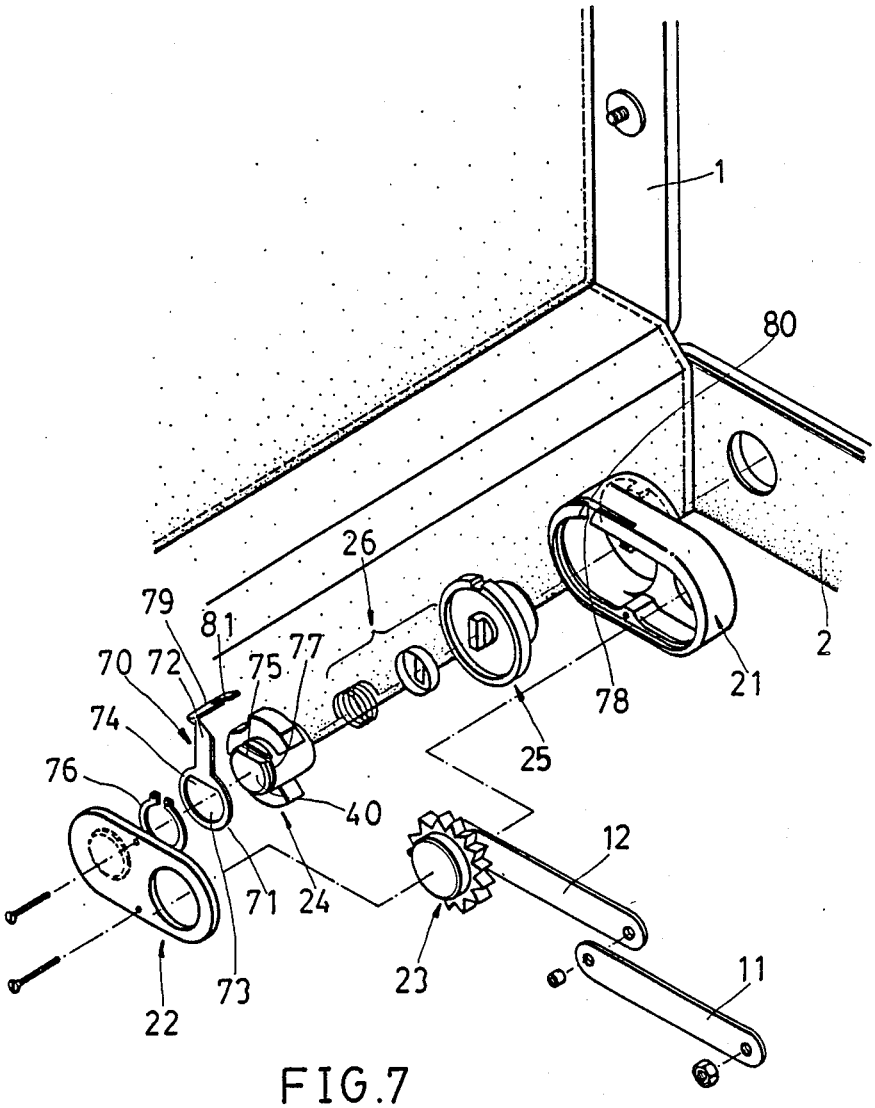
FIG. 7 is an exploded view showing a bracing medium in FIG. 6.
Figure 6:
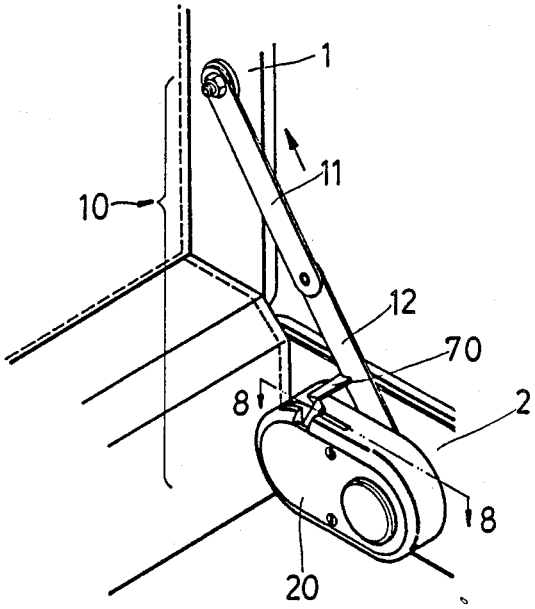
FIG. 6 is a perspective view showing a bracing medium in FIG. 1 incorporating thereon a restoring mechanism with the case being opened.
Figure 8:
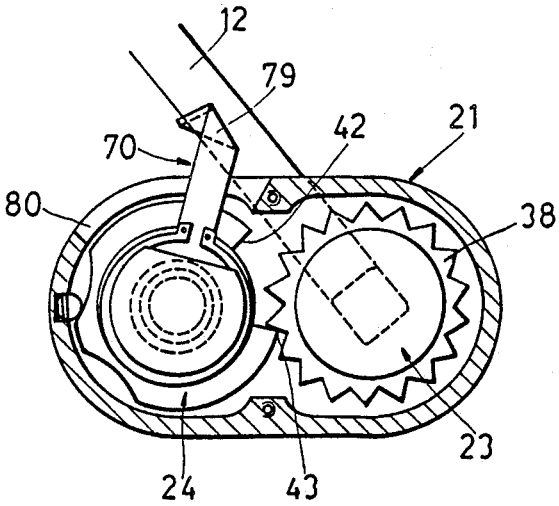
FIG. 8 is a sectional view taken along line 8—8 in FIG. 6.

In order to enable an open case (1, 2) to be closed without a key, the present bracing medium 10 is further provided with a restoring mechanism, a preferred embodiment of which as shown in FIGS. 6–8 is a bent piece 70 and includes a first end 71 having a generally circular hole 73 having a flat wall 74 and mounted on shaft 40 having a corresponding flat portion 75 to be fixed thereto by a retainer 76 retained in an annular groove 77 provided on shaft 40, a bent intermediate 72 passing through a side recess 78 of housing 21 and receiprocatingly slidable in a side slit 80 of housing 21, and a second end 79 having an indentation 81 capable of positively matching therein a specific segment of lower arm 12 so that after arms 11, 12 have been put in straight, if cover 1 is further pivoted away from body 2 a little more, lower arm 12 will urge bent piece 70 to bring pawling end 43 into contact with ratchet wheel 38 capable of only rotating clockwise now to allow cover 1 to be covered against body 2.

What I claim is:

1. A bracing medium for a case having a body and a cover comprising:

an upper arm having a first end pivotally connected to said cover and a second engaging end;

a lower arm having a first end pivotally connected to said second engaging end and a second free end;

a housing held attached to said body;

a follower rotatably mounted in said housing and secured to said second free end;

a lock mounted in said housing and having a tumbler having a keyhole reachable from an outside of said case;

a pawling member engageable with said follower and limitedly rotatably mounted in said housing in a manner that when positioned in a first position, said member can pawl said follower against rotating in a first direction and when positioned in a second position, said member can pawl said follower against rotating in a second opposite direction; and a clutch mechanism mounted between said tumbler and said pawling member which are mutually engageable to simultaneously rotate by a key to selectively position said pawling member in one of said first and second positions.

2. A bracing medium according to claim 1 wherein said follower includes a ratchet wheel having an axle secured to said free end.

3. A bracing medium according to claim 2 wherein said pawling member includes a shaft and an incomplete annulus mounting on said shaft and having two pawling ends respectively engageable with said ratchet wheel to define said first and second positions for said pawling member.

4. A bracing medium according to claim 3, further comprising a coil spring and a ball and wherein said housing includes a recess receiving therein said coil spring and partly receiving therein said ball and said incomplete annulus includes two spaced indentations respectively engageable with said ball to assistantly define said first and second positions for said pawling member.

5. A bracing medium according to claim 1 wherein said clutch mechanism includes:

an engaging piece fixed to said tumbler and engageable with said pawling member; and a coil spring mounted between said tumbler and said pawling member so that when said key is inserted into said keyhole, said engaging piece can be urged to engage with said pawling member in order that said tumbler and said pawling member can be simultaneously rotated by said key.

6. A bracing medium according to claim 1, further comprising a restoring mechanism generally mounted in said housing and capable of rotating said pawling member in order to change for said pawling member from one of said first and second positions which prevents said cover from being covered against said body into the other.

7. A bracing medium according to claim 6 wherein said restoring mechanism is a bent piece having a first end fixed to said pawling member and a second end engageable by said lower arm.

8. A bracing medium according to claim 6 wherein said restoring mechanism is mounted between said follower and said pawling member.

* * * * *